US009279210B2

(12) United States Patent
Perini et al.

(10) Patent No.: US 9,279,210 B2
(45) Date of Patent: Mar. 8, 2016

(54) PACKING SPACER FOR WASHING MACHINES

(75) Inventors: Carlo Perini, Fabriano (IT); Enrico De Angelis, Matelica (IT)

(73) Assignee: V.I.C. VITERIE ITALIA CENTRALE S.R.L., Fabriano (IT)

( * ) Notice: Subject to any disclaimer, the term of this patent is extended or adjusted under 35 U.S.C. 154(b) by 1158 days.

(21) Appl. No.: 13/138,892

(22) PCT Filed: May 11, 2009

(86) PCT No.: PCT/IT2009/000205

§ 371 (c)(1),
(2), (4) Date: Oct. 18, 2011

(87) PCT Pub. No.: WO2010/131269

PCT Pub. Date: Nov. 18, 2010

(65) Prior Publication Data

US 2012/0031796 A1 Feb. 9, 2012

(51) Int. Cl.
*B65D 81/02* (2006.01)
*D06F 39/00* (2006.01)

(52) U.S. Cl.
CPC ..... *D06F 39/001* (2013.01)

(58) Field of Classification Search
USPC ..... 206/591, 592, 593, 594, 521
See application file for complete search history.

(56) References Cited

U.S. PATENT DOCUMENTS

| | | | | | |
|---|---|---|---|---|---|
| 4,240,550 | A * | 12/1980 | Collin | 206/320 |
| 5,056,341 | A * | 10/1991 | Mori et al. | 68/3 R |
| 5,946,946 | A * | 9/1999 | Sharp et al. | 68/23.1 |
| 6,029,480 | A * | 2/2000 | Colombera | 68/23.1 |
| 7,475,572 | B2 * | 1/2009 | Lappoehn et al. | 68/3 R |
| 2009/0107829 | A1 * | 4/2009 | Heimann | 200/600 |
| 2011/0132799 | A1 * | 6/2011 | Lee | 206/586 |
| 2012/0180200 | A1 * | 7/2012 | Gaudet | 2/411 |

FOREIGN PATENT DOCUMENTS

| | | | |
|---|---|---|---|
| DE | 9206506.6 | | 9/1993 |
| EP | 0 916 760 | A2 | 5/1999 |
| EP | 1 491 675 | B1 | 12/2004 |
| EP | 1 498 537 | A1 | 1/2005 |
| WO | WO 2006/129176 | * | 12/2006 |

* cited by examiner

*Primary Examiner* — Jacob K Ackun
(74) *Attorney, Agent, or Firm* — Hauptman Ham, LLP

(57) ABSTRACT

The present invention relates to a packing spacer for washing machines, of the type having a monolithic structure obtained from one material, comprising a tubular cylindrical stem (1) with enlarged head (2), both crossed by an axial conduit for a fixing screw (V); said spacer (D) being provided, on the cylindrical stem (1), with a section (4, 40, 400) that collapses elastically when the spacer is subjected to axial compression.

3 Claims, 10 Drawing Sheets

PACKING SPACER FOR WASHING MACHINES

CROSS-REFERENCE TO REPLATED APPLICATIONS

Reference is made to International Application Number PCT/IT2009/000205

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

FIELD OF THE INVENTION

The present patent application relates to a spacer used during packing and transport operations of washing machines.

BACKGROUND OF THE INVENTION

As it is known, washing machines are internally provided with a rotary drum that is designed to be filled with dirty laundry and is exactly housed inside a basically cylindrical oscillating assembly.

In particular, such a drum is provided on the bottom wall with a shaft that, after crossing the bottom wall of the oscillating assembly that contains it, is connected to an electrical motor that drives it into rotation.

Considering that the drum of washing machines is subjected to quite high rotational speed (especially during the spin drier cycle), it appears evident that the rotations generate significant mechanical stress for the oscillating assembly that contains the drum.

In order to prevent the said stress from damaging the structure, the oscillating assembly is mounted inside the case of the appliance with the interposition of suitable elastic connection elements that act as shock absorbers.

Because of the high intensity of the stress, the said elastic elements must be adjusted loosely, in such a way to allow the oscillating assembly to be displaced, including significantly, inside the case.

Although the fact that the oscillating assembly is mounted on the said elastic elements preserves the structural integrity of the oscillating assembly during the operation of the washing machine, it must be noted that such a solution causes a problem during the packing and transport operations of the appliance.

During the said operations, the oscillating assembly of a washing machine is exposed to such strong shaking that it can hit the internal walls of the case of the appliance, causing serious damage.

In order to prevent this problem, when the assembly of the washing machine has been completed, a common practice consists in mounting inside the washing machine some devices designed to stop the oscillations of the oscillating assembly, which are able to neutralise the presence of the said shock absorbers.

Of course, the said devices are designed to operate only during the packing and transport operations of the appliance, and are immediately removed before the appliance is put in operation, when the oscillating assembly is subjected again to the shock absorbing action of the elastic elements fixed to the cabinet.

An especially popular type of the said devices is represented by a spacer that practically consists in a cylindrical pin made of rigid plastic material and provided with enlarged head.

Such a spacer is crossed by an axial hole with circular section, in which a fixing screw is inserted, with suitable length to come out shortly from the front end of the hole.

Such a spacer must be horizontally inserted inside one of the holes provided on the back wall of the cabinet of a washing machine, until the enlarged head touches the external side of the back wall, in such a way to prevent the uncontrolled insertion of the entire spacer inside the appliance.

Following to the said insertion, the tip of the screw inserted in the spacer penetrates inside a hole obtained in corresponding position in the oscillating assembly contained inside the cabinet.

Then the screw of the spacer is screwed, in such a way that the front end of the spacer energetically interfered against the surface of the oscillating assembly and the enlarged head energetically adheres against the external side of the back wall of the cabinet of the appliance.

Evidently, such a spacer obtains a rigid connection between the oscillating assembly and the cabinet of the appliance.

It must be noted that, in order to make the said spacers effective, each of them is provided with an insert that is able to be elastically compressed, causing a bulge on the internal wall of the cabinet, when the screw is engaged in the hole obtained on the oscillating assembly to be stopped.

Generally, the elastically deformable insert consists in a rubber collar designed to be inserted along the same screw that crosses the cylindrical rigid body of a spacer.

In many instances the collar is provided with an enlarged head and for this reason it is designed to be mounted upstream the said cylindrical rigid body, in such a way that the enlarged head interferes against the external side of the back wall of the cabinet during the installation of the spacer.

In any case it must be noted that, when the spacer is screwed against the back side of the oscillating assembly, the elastic insert is subjected to a compression load that causes circumferential expansion, thus strengthening the connection between the oscillating assembly of a washing machine and the corresponding cabinet.

In fact, also when the oscillating assembly is subjected to stress that tends to push it against the back wall of the cabinet, the spacer is no longer free to move backwards and come out of the insertion hole, the said backward movement being prevented by the annular bulge suffered by the said insert under compression.

The said spacers are classified by the experts of the art as "bi-components", because that they are formed of two components: a bearing rigid element and an insert made of elastically expandable material under compression.

A "bi-component" spacer of this type is illustrated in patent WO 2006/129176.

Other models of spacers are known, being characterised in that they have a monolithic structure that comprises a cylindrical stem and an enlarged circular head, both crossed by an axial conduit for the screw used to fix the spacer between the oscillating assembly and the back wall of the cabinet of the washing machine.

In order to provide secure coupling between the circular head and the back wall of the cabinet, the head is provided with an annular groove, whereas the back wall of the cabinet is provided with a "keyhole"-type hole, with "eye" having the same diameter as the cylindrical stem of the spacer, and the width of the slot that starts from the said "eye" is the same as the diameter of the said annular grove.

This means that, once the cylindrical stem of the spacer has been inserted into the eye of the "keyhole-type" hole, the installer must slide the spacer laterally, in parallel direction, in order to insert the edges of the slot into the annular groove of the head of the spacer, which is interlocked in the back wall of the cabinet.

A spacer of this second type is disclosed in patent EP 0916760.

Although this second type of spacer is preferred to the first one because of its monolithic structure, which is simple and inexpensive to make, it is impaired in that it requires the drilling of "keyhole"-type holes on the back wall of the cabinet.

BRIEF SUMMARY OF THE INVENTION

The purpose of the present invention is to provide a new model of spacer with all the advantages offered by the two aforementioned types of spacers and without the respective drawbacks.

In other words, it can be said that the purpose of the present invention is to provide a spacer with monolithic structure that can be fixed into an ordinary circular hole drilled on the back wall of the cabinet of a washing machine.

To that end, a spacer with monolithic rigid structure has been realised, with cylindrical stem provided with a collapsible, or elastically deformable section designed to perform the same function performed by the rubber collar in the prior models of spacers of "bi-component" type.

Another peculiarity of the new spacer of the invention consists in the fact that it incorporates a second elastically deformable section—a sort of base—on the enlarged head, designed to remain in external position on the back wall of the cabinet of the washing machine.

The function of the shock-absorbing base is to limit the damage suffered by the structure of the appliance during a violent shock (such as in case of fall from a certain height) during storage or transport operations, until the oscillating assembly is rigidly connected with the corresponding cabinet by means of multiple spacers according to the present invention.

In such a case, the violent shaking suffered by the oscillating assembly of a washing machine could generate an energetic traction force towards the inside of the appliance with respect to the screws of the various spacers engaged in the structure of the oscillating assembly.

Following to such an energetic traction, the enlarged heads of the spacers could easily cause some damage (dents in the best case) on the back wall of the cabinet of the appliance where the heads are engaged from the outside.

The presence of the said deformable base on the spacer of the invention is justified with the intention to create a shock absorbing section that is effectively capable of absorbing the effects of a sudden violent traction suffered in external-internal direction by the spacer during the accidental fall of the appliance.

It is worthless saying that the absorption of such a traction force prevents the damage caused to the sheet metal back wall of the case of the appliance.

BRIEF DESCRIPTION OF THE SEVERAL VIEWS OF THE DRAWINGS

For purposes of clarity, the description of the invention continues with reference to the enclosed drawings, which are intended for purposes of illustration only and not in a limiting sense, wherein.

DETAILED DESCRIPTION OF THE INVENTION

With reference to the aforementioned figures, the spacer of the invention (D) has a monolithic structure obtained from moulding plastic materials, which comprises a basically cylindrical stem (1) that ends with an enlarged circular head (2) at one end.

The enlarged head (2) is provided in the centre with the hole (3) of an axial conduit that crosses the entire spacer and is designed to receive a screw (V) used to fix the spacer and provided with such a length to make the tip protrude shortly from the cylindrical stem (1).

A first peculiarity of the spacer (D) consists in that the enlarged head (2) is situated upstream a section (4) that can collapse elastically in axial direction, which is incorporated in the cylindrical stem (1).

In particular, the collapsible section (4) is obtained in intermediate position between a first short portion (1*a*) of the cylindrical stem (1), i.e. the portion that protrudes directly on the back on the enlarged head (2), and a second longer portion (1*b*) downstream the collapsible section (4).

Figure 1A:
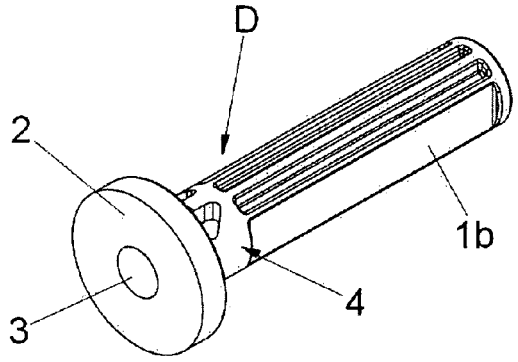
FIG. 1A is an axonometric view of a first embodiment of the spacer of the invention.
Figure 1B:
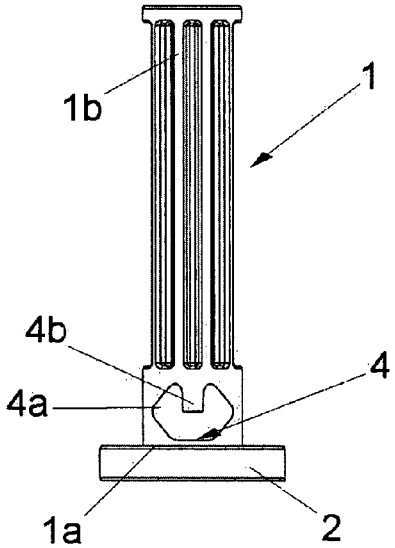
FIG. 1B is a top view of the spacer of FIG. 1A, with the collapsible section not in compressed condition.
Figure 1C:
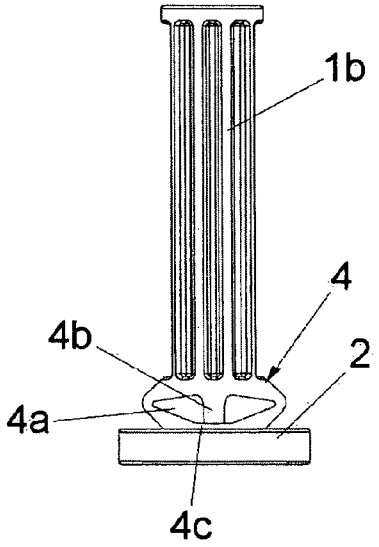
FIG. 1C is the same as 1B, except for that it shows the spacer in the position adopted when the collapsible section is in compressed condition.
Figure 1D:
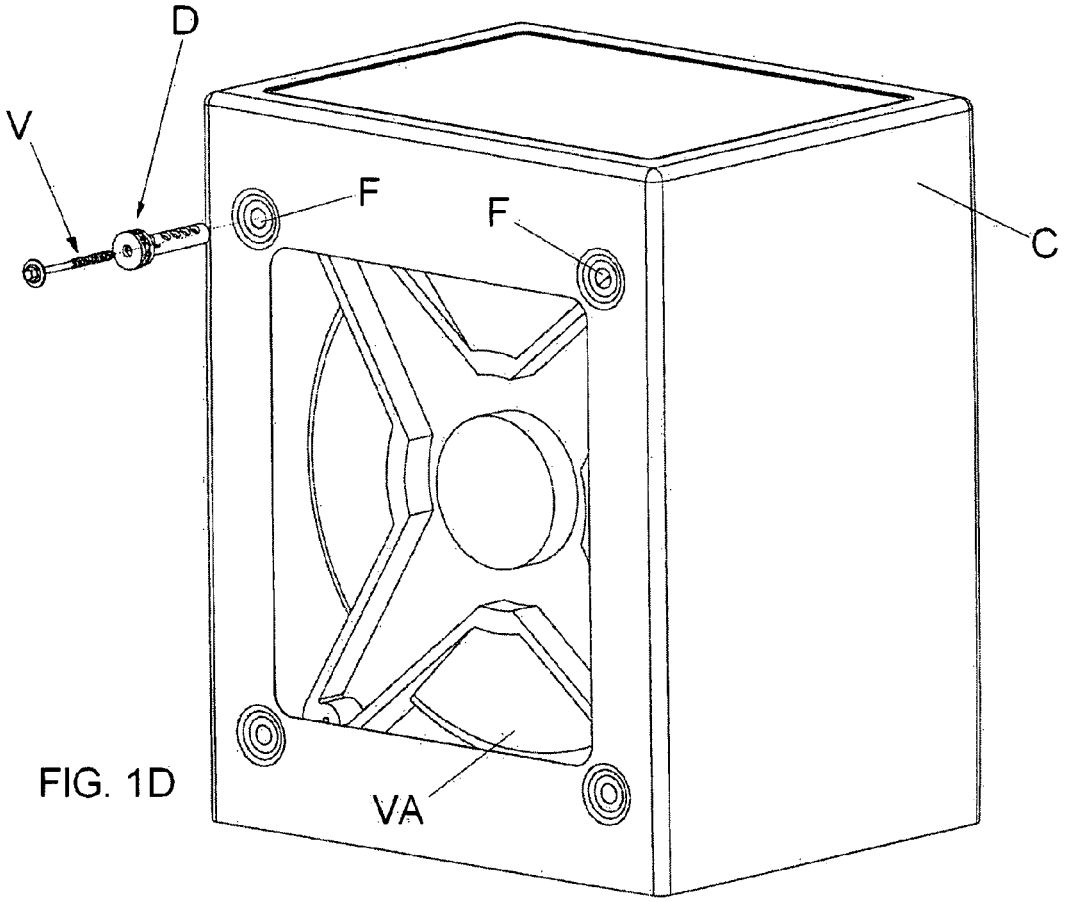
FIG. 1D is an axonometric back view of a washing machine that shows the installation modes of the spacer of the figures above.

With reference to FIG. 1D, such a spacer (D) is designed to be inserted horizontally through one of the ordinary holes (F) provided on the back wall of the cabinet (C) of a washing machine, until the enlarged head (2) interferes against the back wall.

Following to this operation, the tip of the screw (V) of the spacer (D) engages inside a back hole obtained on the back horizontal wall of the oscillating assembly (VA) housed in the washing machine.

Now the screw (V) is tightened, making the tip engage deeply inside the corresponding hole of the oscillating assembly (VA).

As mentioned above, during this operation the front end of the cylindrical stem (1) is engaged rather energetically against the oscillating assembly (VA), whereas the collapsible section (4) of the spacer is subjected to energetic compression that causes a circumferential expansion, technically known as "bulging", as shown in FIG. 1C.

It must be noted that the said "bulging" is not a problem when the spacer is extracted backwards from the hole (F) for final removal.

Considering that the collapsible section (4) is characterised by moderate elastic return, once the screw (V) has been removed, it tends to shrink spontaneously and is then subjected to additional radial contraction due to the interference with the edge of the hole (F) where the spacer (D) is contained.

According to the embodiment shown in FIGS. 1A, 1B and 1C, the elastically collapsible section (4) is provided with a large transversal through window (4*a*) with polygonal section, which contains a support peg (4*b*), facing the enlarged head (2), that extends for approximately half of the length of the window (4*a*).

The presence of the window (4*a*) allows to significantly reduce the section of the collapsible section (4) of the spacer (D), thus guaranteeing its capability to be elastically compressed when the screw of the spacer is engaged into the corresponding hole obtained on the oscillating assembly (VA) to be fixed.

FIG. 1B illustrates the structure of the collapsible section (4) in non-operating position, whereas FIG. 1C illustrate the same section (4) in operating position, when it is subjected to significant compression (followed by actual "bulging") until the peg (4*b*) is stopped against the internal edge (4*c*) of the window (4*a*).

Figure 2B:
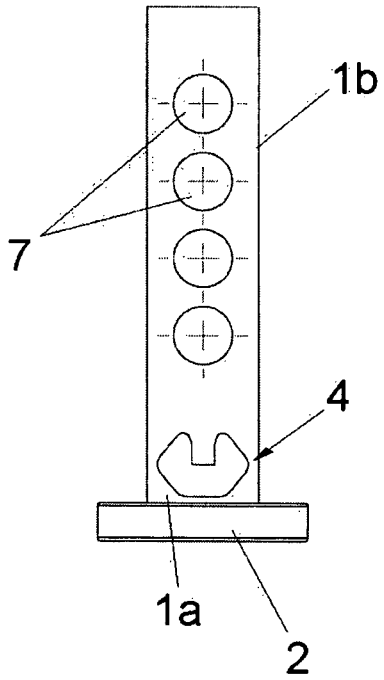
FIG. 2B is a top view of the spacer of FIG. 2A, with the collapsible section not in compressed condition.
Figure 2A:
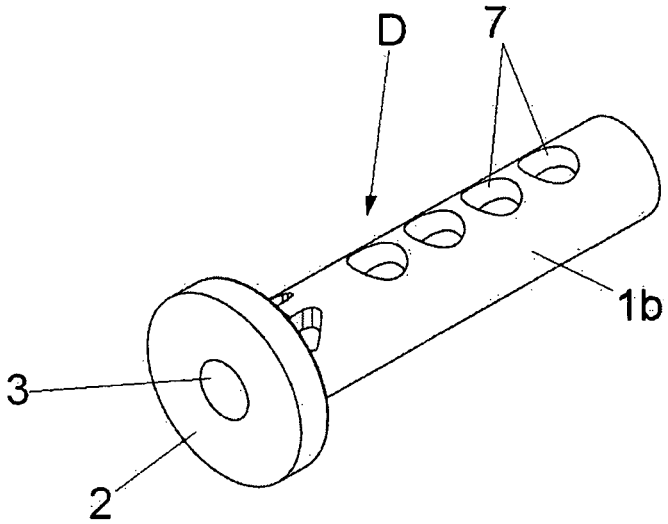
FIG. 2A is an axonometric view of a second embodiment of the spacer of the invention.
Figure 2C:
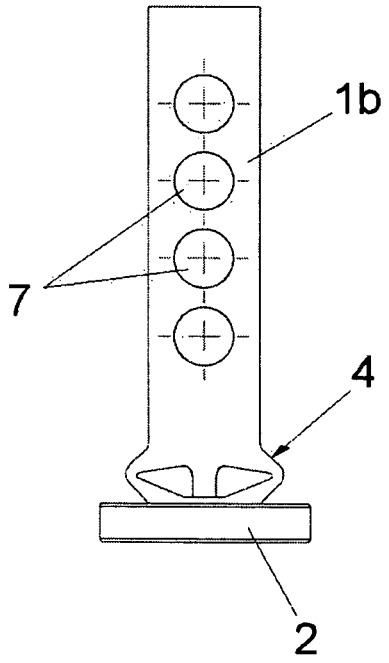
FIG. 2C is the same as 2B, except for that it shows the spacer in the position adopted when the collapsible section is in compressed condition.

FIGS. 2A, 2B and 2C illustrate an embodiment of the spacer (D) that is basically identical as the one illustrated above, except for the presence of a series of through transversal holes (7) in the cylindrical stem (1).

The function of the said holes (7) is to allow, although limitedly, for elastic deformation in axial direction of the entire cylindrical stem (1), when the washing machine in which the spacer (D) has already been installed is subjected to a rather violent shock, possibly due to accidental fall.

In such a case the spacer (D) would tend to transmit a very strong stress from one component to the other—the oscillating assembly (VA) and the cabinet (C)—between which it is rigidly positioned, with the risk of serious damage for their integrity.

The presence of the said holes (7), and consequently the capability to suffer non-traumatic, elastic deformation, allows the cylindrical stem (1) to operate as shock absorber and instantaneously absorb in its structure (through a limited reduction in length) most of the stress that would be dangerously discharged between the oscillating assembly (VA) and the cabinet (C) of the appliance.

A similar intrinsic shock-absorbing capability is additionally developed, although with different technical-functional solutions, in the embodiments of spacer (D) illustrated in figures from 3A to 4C.

Figure 3B:
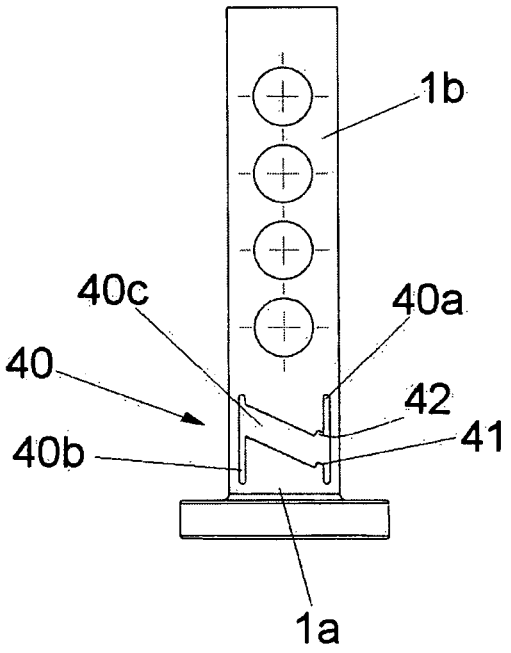
FIG. 3B is a top view of the spacer of FIG. 3A, shown with the collapsible section not in compressed condition.
Figure 3A:
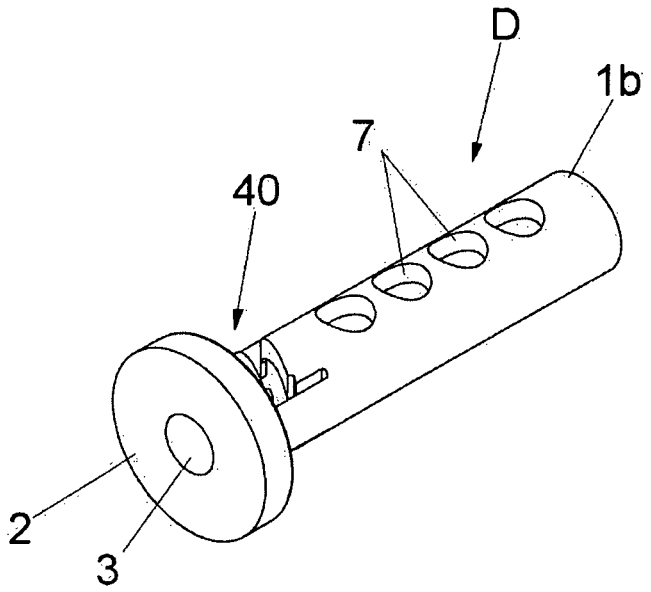
FIG. 3A is an axonometric view of a third embodiment of the spacer of the invention.
Figure 3C:
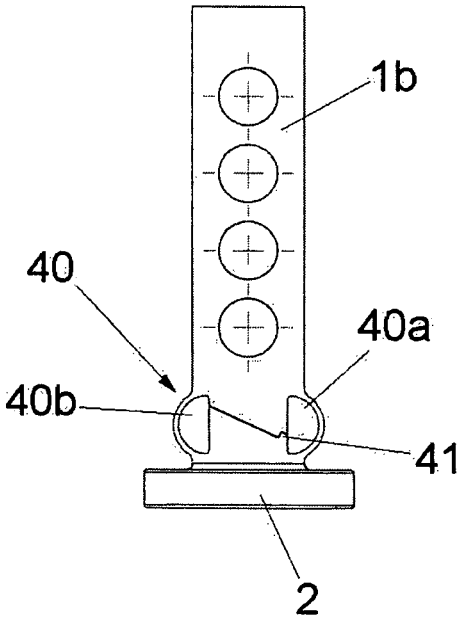
FIG. 3C is the same as 3B, except for that it shows the spacer in the position adopted when the collapsible section is in compressed condition.

The embodiment of spacer (D) illustrated in FIGS. 3A, 3B and 3C is characterised by the special configuration given to the collapsible section (40) of the cylindrical stem (1).

It is provided with a through transversal notch that, in plan view, has a basically N-shaped profile that comprises two thin longitudinal sections (40*a*, 40*b*) obtained in opposite position near the lateral edges of the cylindrical stem (1) and connected by means of a central oblique section (40*c*) with higher width.

In the connection point between the oblique section (40*c*) and the first section (40*a*) of the said longitudinal sections a tooth (41) is provided, which protrudes frontally on the first portion (1*a*) of the cylindrical stem (1), which corresponds to an opposite seat (42) obtained on the front of the second portion (1*b*).

FIG. 3C illustrates the position of the collapsible section (40) during the stress suffered by the spacer (D) when the screw is engaged on the bottom of the oscillating assembly (VA) to stop.

Also in this case, the collapsible section (40) is subjected to compression, with consequent "release", due to the presence of the opposite lateral notches (40*a*, 40*b*) and of the central oblique notch (40*c*).

In such a situation, the cylindrical stem (1) of the spacer (D) is subjected to a reduction in length until the oblique front edges of the portions (1*a*, 1*b*) are brought in mutual contact.

Consequently, the tooth (41) that protrudes from the front edge of the first portion (1*a*) of the cylindrical stem (1) is engaged exactly in the corresponding seat (42) obtained in the second portion (1*b*) of the cylindrical stem (1).

The prismatic coupling between the tooth (41) and the seat (42) allows for increasing the capability of the spacer (D) to absorb without damage the violent shocks that may be suffered by the appliance (possibly due to accidental fall) until the cabinet (C) and the oscillating assembly (VA) of the same are rigidly connected by means of a series of said spacers.

Such a violent shock would could additional compression on the spacer (D) rigidly fixed between the oscillating assembly (VA) and the cabinet (C), which is already in such a condition—as illustrated in FIG. 3C—in which the oblique edges of the two portions (1*a*, 1*b*) of the cylindrical stem (1) are already energetically engaged one against the other.

Figure 3D:
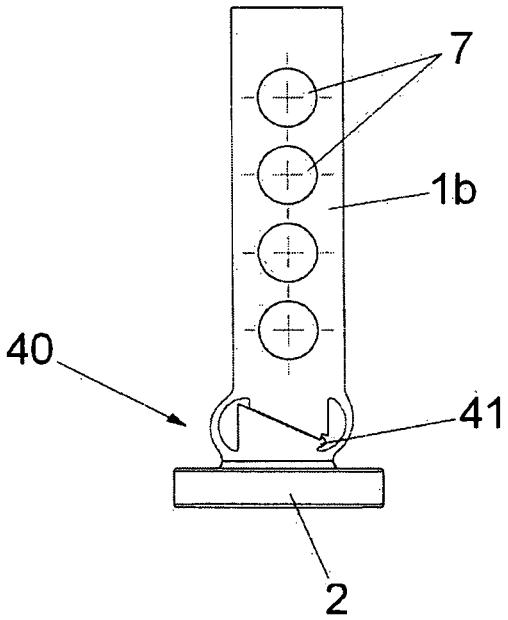
FIG. 3D is the same as 3C, except for that it refers to the position adopted by the spacer in case of additional "traumatic" compression suffered by the spacer.

The additional compression suffered by the spacer (D) would cause the lateral movement of the second portion (1*b*) of the cylindrical stem (1) with respect to the first portion (1*a*), such a movement being evidently favoured by the inclination given to the front edges of the said portions; reference is made to FIG. 3D.

Such a sudden, energetic lateral movement of the second portion (1*b*) of the cylindrical stem (1) would break the tooth (42) that protrudes from the front edge of the first portion (1*a*), thus dissipating most of the undesired energy generated following to the violent shock suffered by the entire appliance.

Figure 4B:
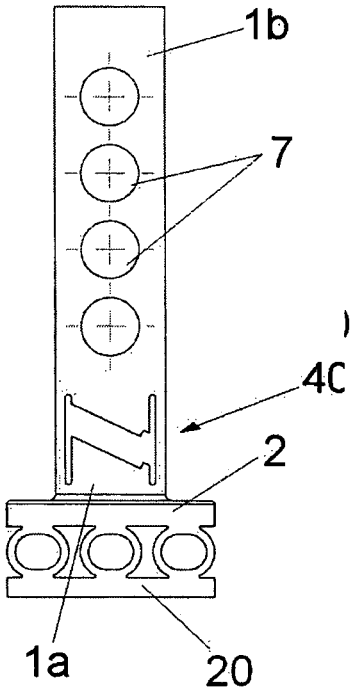
FIG. 4B is a top view of the spacer of FIG. 4A, with the collapsible section not in compressed condition.
Figure 4A:
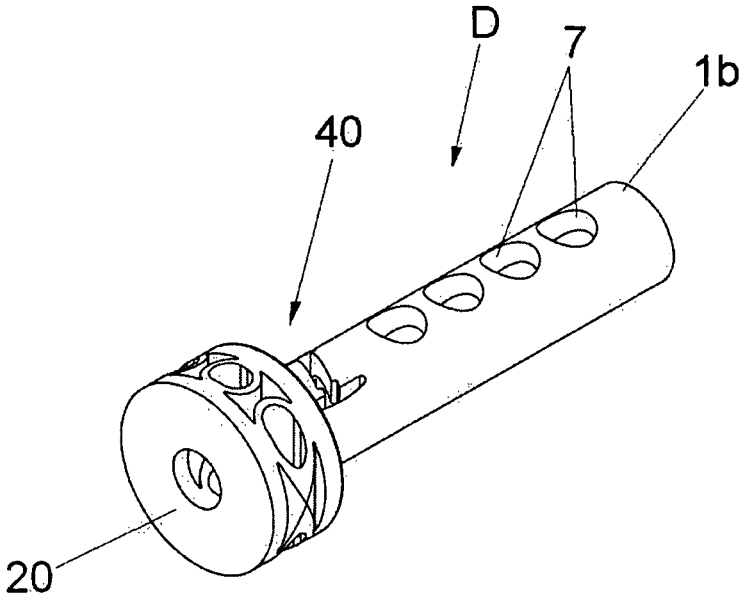
FIG. 4A is an axonometric view of a fourth embodiment of the spacer of the invention.
Figure 4C:
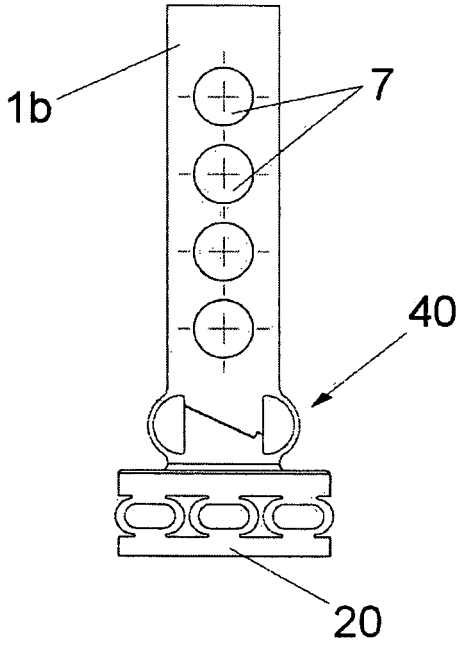
FIG. 4C is the same as 4B, except for that it shows the spacer in the position adopted when the collapsible section is in compressed condition.

In order to dissipate the energy generated by the violent shocks suffered by the entire appliance, the embodiment of spacer (D) illustrated in FIGS. 4A, 4B and 4C is provided with an elastically compressible base (20) obtained in external position on the enlarged head (2) with the same material and during the same moulding operation of the entire spacer (D).

In particular, the shock-absorbing capability of the base (20) originates from the fact that the same is provided with reticular structure, lightened by the presence of a series of through notches.

Figure 5B:
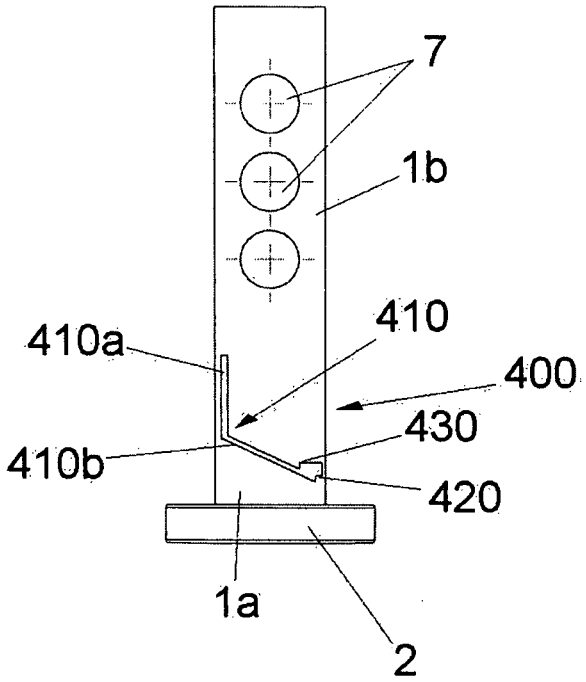
FIG. 5B is a top view of the spacer of FIG. 5A, shown with the collapsible section not in compressed condition.
Figure 5A:
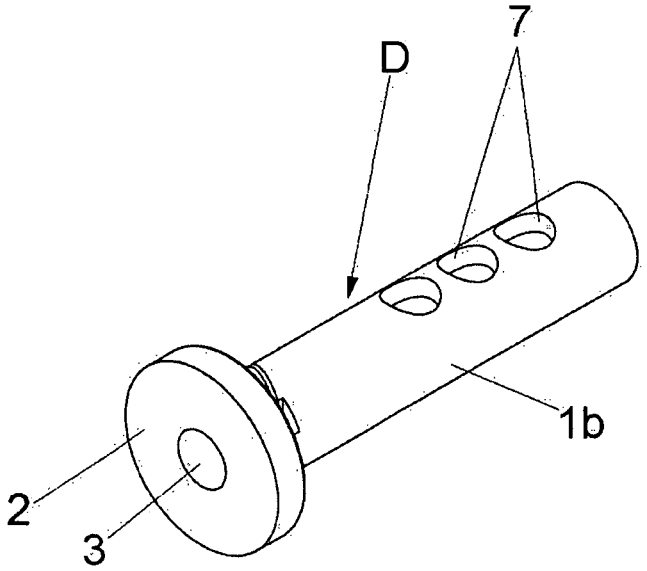
FIG. 5A is an axonometric view of a fifth embodiment of the spacer of the invention.
Figure 5C:
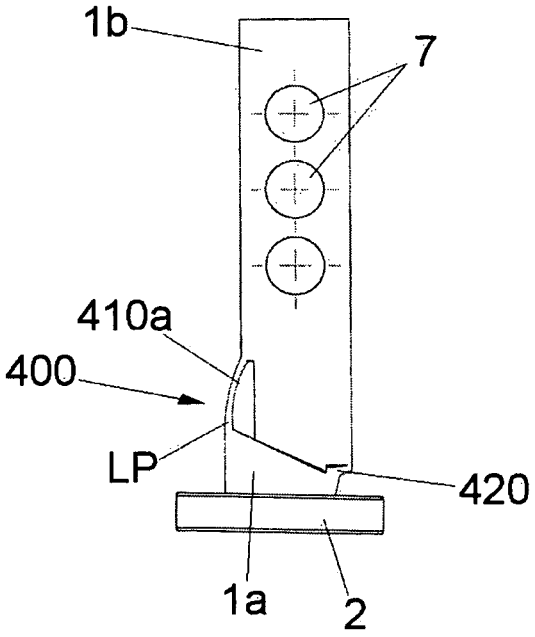
FIG. 5C is the same as 5B, except for that it shows the spacer in the position adopted when the collapsible section is in compressed condition.

According to the embodiment of the invention illustrated in FIGS. 5A, 5B and 5C, the spacer (D) is provided with another constructive solution for the realisation of the elastically collapsible section (400).

In such a case, the collapsible section (400) is obtained by making, through the cylindrical stem (1), a basically L-shaped through notch (410) that comprises a first longitudinal section (410*a*) near the lateral edge of the cylindrical stem (1) joined with a second section (410*b*) obtained in the direction of the enlarged head (2), that cuts the cylindrical stem (1) transversally with approximately 45° inclination for nearly the entire thickness.

The free end of the second notch (410*b*) is joined with a tooth (420) in the front edge of the first portion (1*a*) of the cylindrical stem (1), whereas, in the front edge of the second portion (1*b*), it is joined with a corresponding seat (430) provided with basically double width than the one of the tooth (420).

FIG. 5C illustrates the position adopted by the spacer when the spacer is brought in operating position, after the gradual engagement of the screw in the hole obtained on the oscillating assembly (VA) to be blocked with respect to the cabinet (C).

In such a phase, the presence of the basically L-shaped notch (410) favours, inside the cylindrical stem, the lateral movement and advance movement of the second portion (1*b*) until it is stopped against the first portion (1*a*).

At the same time, the tooth (420) is engaged inside the seat (430).

The same FIG. 5C illustrates that, following to the deformation of the spacer (D), the second portion (1*b*) of the cylindrical stem (1) adopts a slightly off-centred position with respect to the second portion (1*b*).

Because of such a position, the thin tongue of plastic material (LP) in external position on the longitudinal section (410*a*) of the notch (410*a*) adopts a basically curved profile and, on the opposite side, the tooth (420) that protrudes from the front of the first portion (1*a*) of the cylindrical stem (1) is forced to adopt an outward protruding position.

Figure 6A:
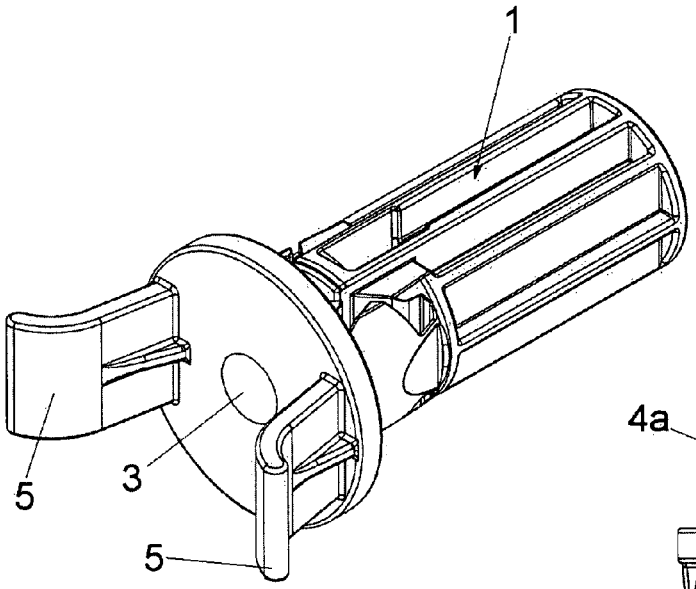
FIGS. 6A and 6B are similar to FIGS. 1A and 1B, but illustrating an additional embodiment of the spacer of the invention.
Figure 6B:
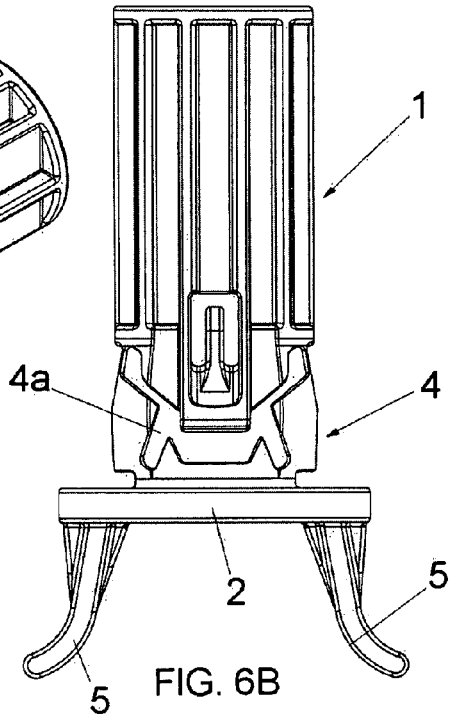

FIGS. 6A and 6B illustrate an additional embodiment of the spacer (D) of the invention, which is basically identical to the one illustrated in FIGS. 1A and 1B, except for the fact that it is provided with an opposite specular pair of catching wings (5) that protrude from the head (2).

The said wings (5) have a profile slightly curved towards the outside to the head (2), in such a way to favour secure catching and energetic traction when the spacer is removed.

The invention claimed is:

1. A packing spacer for washing machines, of the type having a monolithic structure comprising one material, comprising a tubular cylindrical stem (1) with enlarged head (2), both crossed by an axial conduit for a fixing screw (V), spacer (D) provided on the cylindrical stem (1), with a section (4, 40, 400) that collapses elastically when the spacer is subjected to axial compression, wherein the elastically collapsible section (4) is provided with a large transversal through window (4*a*) with polygonal section, which contains a support peg (4*b*), facing the enlarged head (2), that extends for approximately half of the length of the window (4*a*), which is designed to stop against the opposite internal edge (4*c*) of the latter when the collapsible section (40) reaches maximum compression.

2. Packing spacer for washing machines, of the type having a monolithic structure comprising one material, comprising a tubular cylindrical stem (1) with enlarged head (2), both crossed by an axial conduit for a fixing screw (V), spacer (D) provided on the cylindrical stem (1), with a section (4, 40, 400) that collapses elastically when the spacer is subjected to axial compression, wherein the elastically collapsible section (4) is provided with a transversal through window (4*a*) with polygonal section, which contains a support peg (4*b*), facing the enlarged head (2), that extends for approximately half of the length of the window (4*a*), which is designed to stop against the opposite internal edge (4*c*) of the latter when the collapsible section (40) reaches maximum compression.

3. A packing spacer for washing machines, wherein the packing spacer is a monolithic structure of one material, the packing spacer comprising;

a tubular cylindrical stem with an enlarged head on an end of the packing spacer, the enlarged head crossed by an axial conduit, wherein the axial conduct is configured to fix a screw;

wherein the tubular cylindrical stem comprises a section configured to elastically collapse when the packing spacer is subjected to axial compression;

wherein the section comprises:

a transversal through window with a polygonal section comprising a support peg facing the enlarged head, wherein the support peg extends for approximately half of a length of the transversal through window; and wherein the support peg is configured to stop against an internal edge of the transversal through window when the section reaches maximum compression.

* * * * *